United States Patent [19]

Filkow et al.

[11] 4,199,089

[45] Apr. 22, 1980

[54] GLOVE BLOCKING APPARATUS

[75] Inventors: Colin Filkow; Richard S. Smith, both of Winnipeg, Canada

[73] Assignee: Sterling Glove Co. Ltd., Canada

[21] Appl. No.: 935,753

[22] Filed: Aug. 22, 1978

[51] Int. Cl.[2] ..... A41D 19/04

[52] U.S. Cl. ..... 223/79; 223/80

[58] Field of Search ..... 223/78, 79, 80, 51, 223/60, 70, 73, 76, 74, 77

[56] References Cited

U.S. PATENT DOCUMENTS

| | | | |
|---|---|---|---|
| 915,465 | 3/1909 | McBride | 223/79 |
| 1,048,682 | 12/1912 | Goltman | 223/80 |
| 1,562,631 | 11/1925 | Goltman | 223/79 |
| 2,566,552 | 9/1951 | Boldizzoni | 223/79 |
| 2,959,331 | 11/1960 | Boldizzoni | 223/80 X |

*Primary Examiner*—Louis Rimrodt

*Attorney, Agent, or Firm*—Hirons, Rogers & Scott

[57] ABSTRACT

A glove blocking apparatus comprises a heated mandrel which consists of first and second separate glove receiving members. The glove receiving members can be moved between a first adjacent closed position and a second mutually separated position by power means. A glove to be blocked is mounted over the mandrel with the glove receiving members in their adjacent, closed position, and then the glove receiving members move to their separated position to stretch the glove. Stop means are provided to define the second, separate position so as to assist in determining the final size of the glove. There may be one such apparatus for stretching the palm portion of the glove in an endwise direction, and a second such apparatus provided with finger stall receiving formations, for stretching the glove and the finger stalls thereof in the face-to-face direction.

7 Claims, 9 Drawing Figures

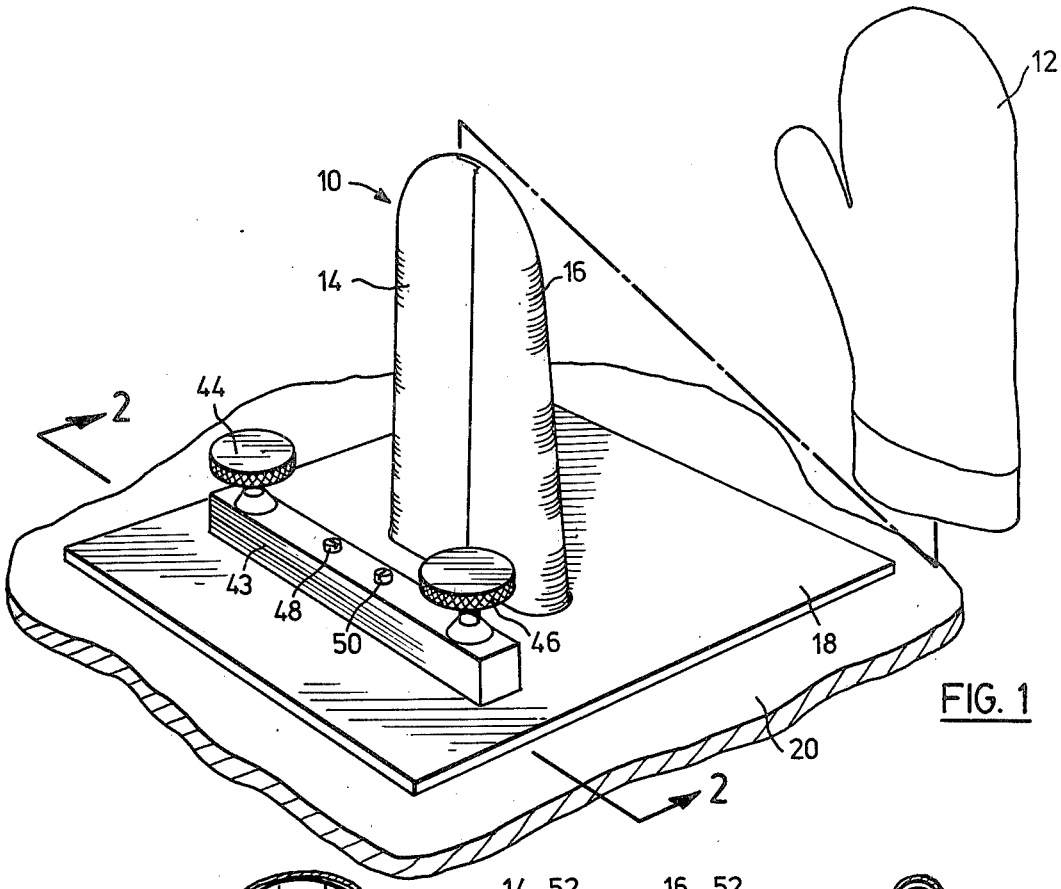
FIG. 1
FIG. 4
FIG. 5
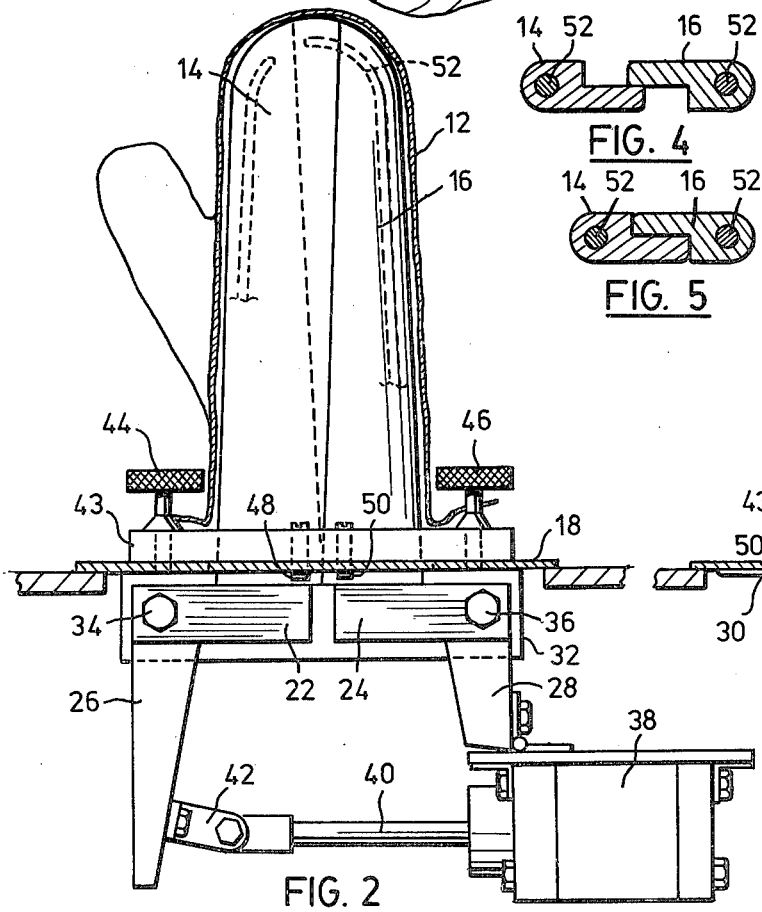
FIG. 2
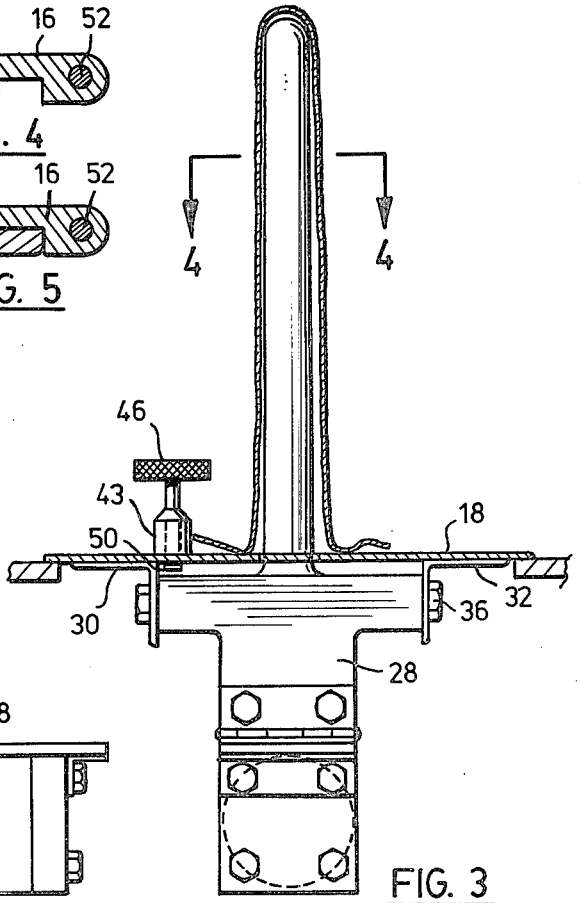
FIG. 3

GLOVE BLOCKING APPARATUS

FIELD OF THE INVENTION

This invention relates to glove making, and particularly to apparatus for the blocking and finishing of leather and the like gloves. The term "glove" in the following specification and claims is used to embrace both gloves and mitten, i.e. hand covering garments with or without a plurality of finger stalls.

BACKGROUND OF THE INVENTION

In the manufacture of leather and the like gloves, the pieces of leather are stitched together in face-to-face fashion with the glove generally arranged inside out. In finishing the stitched glove, it must be turned rightside out, with the result that the seams protrude inwardly. Then the glove must be stretched to its final size. The seams must be straightened and flattened, so that they do not unduly restrict access of the wearer's hand, and so that the glove shall be comfortable to wear. Heat is applied to "set" the glove in its final shape and improve its appearance. The process of stretching the glove, flattening the inwardly protruding seams and heat setting the glove is generally known as blocking the glove. with the result that the seams protrude inwardly. So that the seams do not unduly restrict access of the wearer's hand to the interior of the glove, and so that the glove shall be comfortable to wear, the seam must be flattened. The process of flattening the inwardly protruding seams of a stitched glove is generally known as blocking the glove.

BRIEF DESCRIPTION OF THE PRIOR ART

Blocking is normally performed by drawing the glove after turning it to rightside out, over a heated mandrel which is the full size of the finished glove. It is during this process that many errors in cutting or sewing are corrected, and the glove is stretched out to its final and correct size and shape. The glove is applied manually, left on the mandrel for the requisite length of time, and removed manually.

The conventional blocking process is thus both labor and equipment intensive. The loading and unloading of the mandrel is performed manually. A different size of mandrel is required for each size of glove. The mandrel must of necessity be a close fit inside the glove, so that the operator must expend considerable effort in applying the glove over it. Conventional mandrels are designed so that the operator must pull the glove onto the mandrel in a lengthwise direction. Most of the stretching which takes place during blocking, however, is acros the glove. The application of force lengthwise to load the mandrel, i.e. in a direction transverse to the desired blocking direction, is wasted effort, and leads to waste materials due to breakage. In such conventional processes, the seams are straightened by inserting a steel bar between the glove and its close fitting mandrel, and working it into proper position. Inevitably, tearing of material and breakage of seams occurs to an undesirable extent, to give waste and scrap material.

SUMMARY OF THE INVENTION

It is an object of the present invention to provide a new and improved glove blocking apparatus.

It is a further object to provide such an apparatus which can be used with reduced operator effort.

It is a further object to provide such an apparatus which in operation will reduce the chances of inflicting damage on the glove being blocked.

It is a further object to provide such an apparatus which can be used to block a variety of different sizes of gloves.

It is a further object to provide an apparatus which will facilitate seam stretching of a glove.

The present invention provides a glove blocking apparatus which incorporates an expandable mandrel. Two glove receiving members make up the mandrel. They can be arranged in a mutually close, adjacent position facilitating loading of the glove thereon. Then they can be moved with power assisted means to a second mutually separated position in which they stretch and block the glove. Upon return of the glove receiving members to their initial, close position, the finished glove can be readily removed and the cycle of operation repeated with another glove. With the glove held on the closed mandrel, after expansion of the mandrel to cause blocking, the seams can be straightened by hand, using light finger pressure. The mandrel halves can then be expanded to their second, separated position so as to set the seams in their straightened position.

Thus, according to the present invention, there is provided a glove blocking apparatus comprising:

- a first glove receiving member;
- a second glove receving member juxtaposed to said first member so as to allow placing of an unblocked glove over both of said first and second members simultaneously;
- the first and second glove receiving members being movable relative to one another between a first mutually adjacent, closed position and a second, mutually separated position;
- driving means connected to at least one of the first and second glove receiving members and adapted to cause movement of said first and second glove receiving members relative to one another, between their said first and second relative positions.

The provision of the expandable mandrel, comprised of the two relatively movable glove receiving members, substantially overcomes the problem of operator effort, and consequent likelihood of damage, in forcing the glove over a closely sized fixed mandrel. By suitable definition of the second mutually separated position of the members, the same mandrel can be arranged to block a variety of glove sizes.

DESCRIPTION OF THE PREFERRED EMBODIMENTS

Preferably, the glove blocking apparatus according to the invention includes stop means for engagement with at least one of the glove receiving members, so as to define the second, mutually separated position. The stop means is advantageously positionally adjustable to define a series of alternate second positions for the glove receiving members, of different mutual separations, thereby rendering the apparatus useful in the production of a variety of sizes of gloves, from the same expandable mandrel. It is most preferred to have both the first and second glove receiving members movable, and to provide a stop means for each of said glove receiving members.

In one preferred embodiment of the invention, the first and second glove receiving members comprise complementary portions of a glove shaped mandrel, mounted in face-to-face relationship, and movable between their first and second relative positions in the face-to-face direction. Such an embodiment of the apparatus can include finger stall receiving members on the mandrel, and can be used for blocking in the face-to-face direction, of both the finger stalls and the palm portion of the glove. Another embodiment of the apparatus according to the invention has the first and second mitten receiving members forming complementary portions of a mitten shaped mandrel, but mounted at least partially in end-to-end relationship, and movable between their first and second relative positions in the end-to-end direction. This embodiment of the apparatus can be used for blocking the end seams of the mitten, by expanding the mitten on the heated mandrel in the end-to-end direction. Normally, these apparatus perform a complete and adequate blocking job on the glove or mitten, but if necessary they may be used in tandem with one another. Thus, a glove may initially be blocked using the embodiment which has the glove receiving members movable in end-to-end direction, so as to block the palm portion of the glove in end-to-end manner. Then the glove may be transferred to an apparatus according to the other preferred embodiment of the invention, optionally bearing finger stall receiving portions, in which the glove may be blocked in the face-to-face direction, with expansion of the mandrel in this sense.

According to another preferred embodiment, a further apparatus according to the invention may be provided for blocking the thumb stall of a glove, with the mandrel of a size suitable to receive thereon the thumb stall of a glove, and the mandrel having first and second glove receiving portions as aforesaid, to form an expandable mandrel for blocking the thumb stall. Since the thumb stall of a glove protrudes at a substantial angle to the direction of extension of the finger stalls, it is not convenient to provide thumb stalls on the same mandrel as the finger stalls, since loading of a glove thereon is extremely difficult.

This apparatus for blocking the thumb stall of a glove may be used in tandem, with either or both of the mitten blocking and glove blocking apparatus embodiments described above.

FIG. 1 is a diagrammatic perpsective view of an apparatus according to one embodiment of the present invention;

FIG. 2 is a sectional view along the line 2—2 of FIG. 1;

FIG. 3 is an end view of the apparatus of FIGS. 1 and 2;

FIG. 4 is a sectional view along the line 4—4 of FIG. 3, with the mandrel parts in the separated position;

FIG. 5 is a view similar to FIG. 4 but with the mandrel parts in the closed position;

In the drawings, like reference numerals indicate like parts.

DETAILED DESCRIPTION OF THE SPECIFIC PREFERRED EMBODIMENTS

Figure 6:
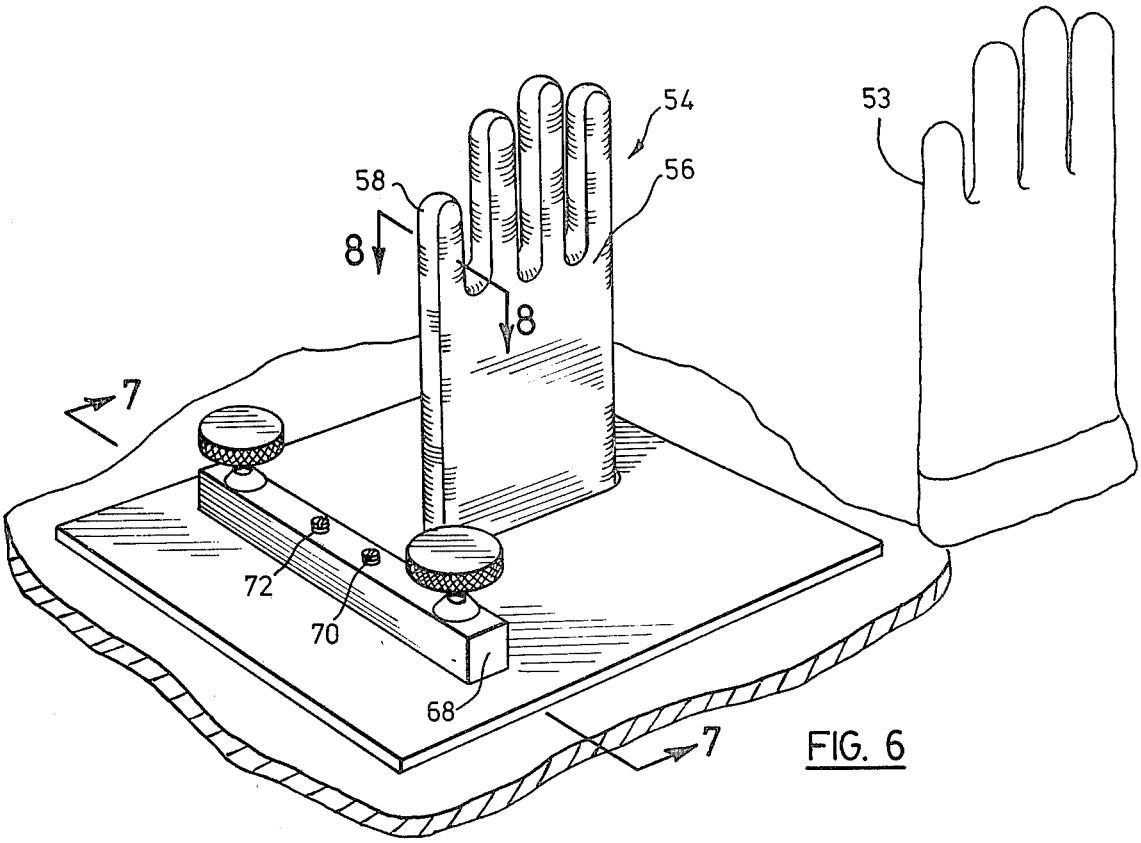
FIG. 6 is a diagrammatic perspective view of an apparatus according to a second embodiment of the present invention.
Figure 7:
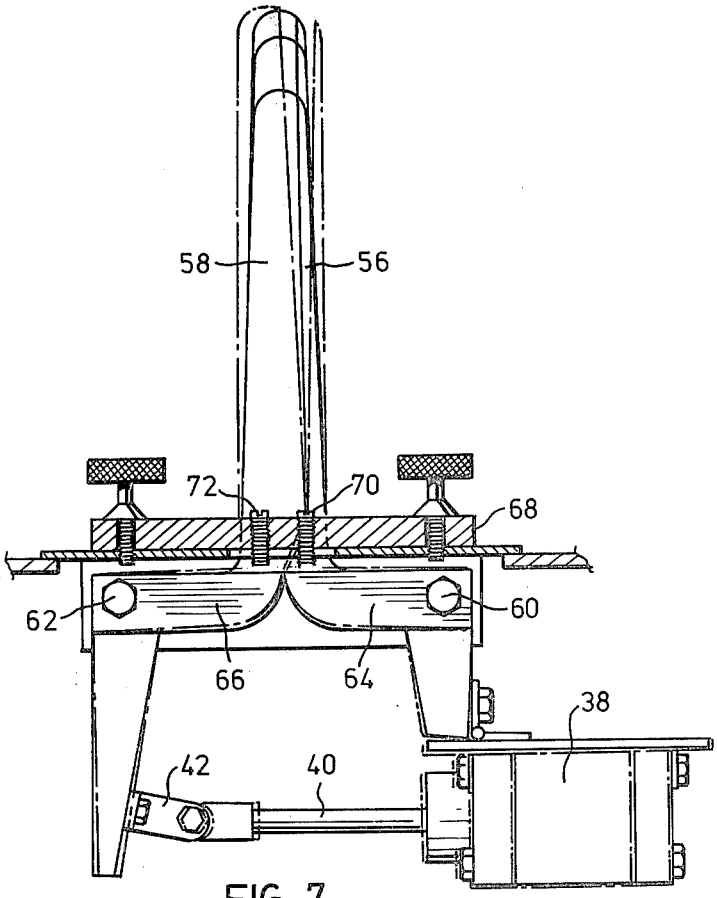
FIG. 7 is a sectional view along the line 7—7 of FIG. 6.

With reference to FIGS. 1-3, the apparatus shown therein comprises a mandrel 10 generally in the shape of a mitten and adapted to receive a mitten 12 thereon. The mandrel 10 consists of a first glove receiving member 14 and a second glove receiving member 16, of equal size, and having co-operating cut-away formations at their mutually adjacent edges, as viewed in plan, for mutual co-operation in their closed positions to form smooth, substantially continuous outer surfaces. Thus, the right side of the mandrel 10, as shown in FIGS. 1 and 2, is formed solely by the edge of second member 16, whilst the opposite side edge is formed by portions of both the first member 14 and the second member 16.

The mandrel 10 is upstanding from a fixed base 18 firmly secured over an aperture in a table 20. The members 14, 16 of the mandrel protrude upwardly through the aperture in the table 20. Immediately below the base surface 18, the members 14, 16 are provided with respective integral transverse struts 22, 24 extending generally horizontally away from each other. Each transverse strut 22, 24 is of much larger width than its associated glove receiving member, and has at its outer end a respective integral depending leg 26, 28. Brackets 30, 32 depend from the undersurface of base 18 at either side of and extending along generally parallel to the major faces of the mandrel 10. Pivot pins 34, 36 extend between the brackets 30, 32 and through appropriate pivot apertures near the outer ends of the transverse strut 22, 24, pivotally connecting the glove receiving members 14, 16 to the base 18, for pivoting movement towards and away from each other about a generally horizontal pivot axis extending transversely to the major faces of the mandrel 10.

A driving means in the form of a pneumatic cylinder 38 and piston 40 connected to a source of pneumatic pressure not shown is mounted on the leg 28. The protruding end of piston 40 is pivotally connected to a link 42 secured to the first leg 26. Thus, actuation of cylinder 38 to move piston 40 causes legs 26, 28 to separate or converge, by pivotal movement about pins 34, 36. This causes consequent movement of the first and second glove receiving members 14, 16 of the mandrel 10 relative to each other. These members move between an adjacent, closed position in which the first member 14 nestles in the recess in the second member 16, and a mutually separated position in which the first member 14 moves partially past the side surface of the second member 16 to increase the overall end-to-end dimension of the mandrel 10.

Stop means are provided to limit the extent of relative movement of the first and second glove receiving members 14, 16 away from each other, and hence to define the second, mutually separated position thereof. Thus, there is provided a stop bar 42 releasably clamped onto the top surface of base 18 by means of thumb screws 44, 46, alongside and generally parallel to one major surface of mandrel 10. The stop bar 42 is provided with a pair of stop members 48, 50, threadably received in apertures in the stop bar 42 and extending downwardly thereof through apertures in the base 18, so that their lower ends overlie the top surfaces of the respective transverse struts 22, 24. The stop members 48, 50 are positioned near the centre of end-to-end length of mandrel 10, so that they overlie and can engage struts 22, 24 near the inner extremities thereof.

Both members are provided with electrical cartridge heaters 52 suitably connected to an appropriate external source of electric current. The heaters 52 are thermostatically regulated and serve to heat the entire mandrel 10 sufficiently since the mandrel is constructed of metal.

In operation, the first and second glove receiving members 14, 16 are set in their first closed position initially, touching each other (FIG. 5). Heaters 52 are operative to cause the mandrel 10 to be heated. An unblocked, unfinished mitten 12, which is several sizes larger than the contracted mandrel, is placed over the heated mandrel 10, in the position shown in FIG. 2. The pneumatic cylinder 38 and piston 40 are then actuated to cause the pivoting "scissor" movement about pivots 34, 36 and hence move the members 14, 16 endwise relative to each other to their second, relatively separated position. As this occurs, the inner ends of transverse struts 22, 24 move upwardly until they engage stop member 48, 50 which prevent further movement and hence define the second separate position of the members 14, 16. The apparatus is held in this position for an appropriate period of time to cause blocking of the mitten 12. It will be noted that, even in the mutually separated position, the end peripheries contacting a mitten are continuous, so as properly to flatten a mitten and maintain its seams in contact with heated metal. Then, pneumatic cylinder 38 is actuated to move the members 14, 16 back to the first, closed position. The seams may then be manually straightened and the operation repeated to set the seams in the correct position. Then mitten 12 is removed and another mitten loaded thereon for a subsequent, similar operation.

The stop bar and stop member arrangement illustrated permits the apparatus to be used with a wide variety of mitten sizes, since it allows for a variety of expanded mandrel sizes. For fine adjustment of the separated, second position of the glove receiving member, stop members 48, 50 can be screwed upwardly or downwardly, to protrude to greater or lesser extents below base 18. For adjustments of greater magnitude stop bar 42 can be removed by releasing thumb screws 44, 46 and replaced with another, differently sized bar with its own respective stop members.

Figure 8:
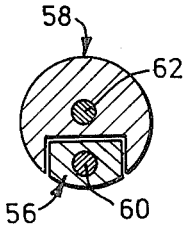
FIG. 8 is a sectional view along the line 8—8 of FIG. 6, with the mandrel parts in the closed position.
Figure 9:
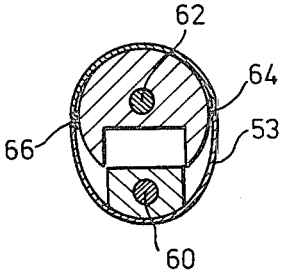
FIG. 9 is a view similar to FIG. 8, with the mandrel parts in the open position.

An alternative embodiment of the invention is shown in FIGS. 6, 7, 8 and 9, the structure and operation of which, however, is essentially similar to that already described. In this case, a glove 53 having finger stalls is to be blocked, and seams within the finger stalls need to be blocked as well. For this purpose, the mandrel 54 is constituted by first and second glove receiving members 56, 58 in face-to-face relationship, each having finger stall receiving formations. The members 56, 58 are movable between a first position in which they are in face-to-face contact and a second position in which they are face-to-face separated, i.e. the movement is in the face-to-face direction. Thus, the mandrel 54 is effectively mounted transversely in comparison to the arrangement of the apparatus in FIGS. 1–3. Member 56 as viewed in plan is much smaller than and fits within recesses in member 58. Thus, as illustrated in FIGS. 8 and 9, the seams 64, 66 of a glove mounted thereon are underlied by the heated metal surface of member 58, even when the mandrel is in its expanded position. Each member 56, 58 is provided with its own set of heaters 60, 62 respectively, extending into the finger stall portions of the mandrels. Maintaining the seam in contact with a heated mandrel portion at all times during the cycle of operation results in complete blocking of the glove on a single mandrel. As in the previous embodiment, the members 56, 58 are pivotally mounted to the base, by pivot pins 60, 62 at the outer ends of transverse struts 64, 66. A removable stop bar 68 with adjustable stop members 70, 72 is provided with the stop members arranged to engage top surfaces of the transverse struts, and hence define the second separated position of the glove receiving membefs, as previously described.

Also in accordance with the present invention, there is provided an essentially similar apparatus for blocking the thumb stall of a glove. As is well known, the thumb stall of a glove extends at an angle approaching 90° from the extent of the finger stalls, so that it is not practical to incorporate a thumb stall receiving formation on the same mandrel as that bearing finger stalls. Consequently, as another embodiment of the invention, for use separately or in tandem with the embodiments described above, an apparatus with an expandable mandrel comprised of two finger receiving portions movable relatively to each other, and sized suitably to receive the thumb stall of a glove, is provided. In this case, the mandrel is constituted by two glove receiving members of size suitable for receiving thereon solely the thumb stall of a glove. The mandrel is heated, and the glove receiving members move between first and second positions as described, to stretch and block the thumb stall of the glove.

A particular problem experienced with conventional mandrels is the difficulty in loading the tip radius of a mitten or the finger stalls of a glove thereon. The present invention very largely overcomes these problems by providing mandrels of a substantially reduced size in these critical areas, so as to ease the loading thereof. The outward, pivoting "scissor" motion of the mitten stretcher of the present invention is of great benefit in smoothing the seams. Since pressure is applied to the gloves and mittens in the most desirable direction, greater pressure may be exerted at higher temperatures, affording substantial savings in time.

It will be appreciated that the foregoing description with reference to the drawings is illustrative and by way of an example only, and is not to be construed as limiting. The scope of the present invention is defined solely by the scope of the appended claims.

We claim:

1. A glove blocking apparatus comprising:

a first glove receiving member;

a second glove receiving member juxtaposed to said first member;

the first and second glove receiving members being movable relative to one another between a first, mutually adjacent, closed position and a second, mutually separated position;

driving means connected to at least one of the first and second glove receiving members and adapted to cause movement of said first and second glove receiving members relative to one another, between their first and second relative positions;

the first and second glove receiving members in their first, mutually adjacent closed position interfitting together to form a glove shaped mandrel which has front and rear major surfaces and opposed smooth eges, for receiving thereon a glove to be blocked, in right side out condition, with edge seams of the glove contacting said opposed edges of the mandrel;

the division between said first and second glove receiving members being located on at least one of the major surfaces of the glove shaped mandrel;

the opposed edges of said glove shaped mandrel constituting smooth surfaces provided by one of said first and second glove receiving members and being uninterrupted by the division between said first and second glove receiving members, so that relative movement of the glove receiving members to their second, mutually separated positions causes the mandrel to expand but leaves continuous smooth edge surfaces in contact with side seams of the glove being blocked thereon.

2. The glove blocking apparatus of claim 1 further including positionally adjustable stop means for engagement with at least one of said glove receiving members, to define a series of alternate second, mutually separated positions thereof, of different mutual separations.

3. The glove blocking apparatus of claim 2 further including heating means for said glove receiving members.

4. The glove blocking apparatus of claim 2 including first and second stop means, for engagement with said first and second glove receiving members respectively.

5. The glove blocking apparatus of claim 2 wherein said first and second glove receiving members protrude from and are pivotally connected to a base surface, so as to move between their first and second positions by limited pivoting movement relative to said base surface, the pivotal mounting of the glove receiving members to the base surface and the driving means for moving the glove receiving members between their first and second positions being located below the base surface and remote from the interfit of the glove receiving members.

6. The glove blocking apparatus of claim 5 wherein the first and second glove receiving members are movable between said first and second relative positions in the face to face direction.

7. The glove blocking apparatus of claim 5 wherein the first and second glove receiving members are movable between said first and second relative positions in the end to end direction.

* * * * *